US005471496A

United States Patent [19]

Becker et al.

[11] Patent Number: 5,471,496

[45] Date of Patent: Nov. 28, 1995

[54] ELECTRODE SUPPORT DEVICE FOR ARC FURNACES

[75] Inventors: Lutz Becker, Duisburg; Andreas Schüring, Mülheim/Ruhr, both of Germany

[73] Assignee: Mannesmann Aktiengesellschaft, Dusseldorf, Germany

[21] Appl. No.: 138,233

[22] Filed: Oct. 15, 1993

[30] Foreign Application Priority Data

Oct. 20, 1992 [DE] Germany ..... 42 36 158.3

[51] Int. Cl.[6] ..... H05B 7/10

[52] U.S. Cl. ..... 373/94; 373/38; 373/52

[58] Field of Search ..... 373/94, 100, 101, 373/36–38, 52

[56] References Cited

U.S. PATENT DOCUMENTS 4,672,628 6/1987 Hill ..... 373/93

5,200,974 4/1993 Kark et al. ..... 373/94

5,283,803 2/1994 Kottnauer et al. ..... 383/36

*Primary Examiner*—Tu Hoang

*Attorney, Agent, or Firm*—Cohen, Pontani, Lieberman, Pavane

[57] ABSTRACT

An electrode support arm for arc furnaces which is constructed as a hollow section with a wall formed at least partially from current-carrying material of high conductivity. The wall of the hollow section has a coolant guiding system including ducts arranged in the wall so as to be parallel to one another and concentric to the center axis of the support arm. The quantity and dimensions of these ducts enable sufficient cooling without a reduction in the strength of the support arm.

7 Claims, 3 Drawing Sheets

ELECTRODE SUPPORT DEVICE FOR ARC FURNACES

BACKGROUND OF THE INVENTION

1. Field of the Invention

The invention is directed to an electrode support device for arc furnaces which includes an arm constructed as a hollow section with a wall formed at least partially from current-carrying material of high conductivity.

2. Description of the Prior Art

Electrodes for arc furnaces for steel production are normally fastened at support arms by electrode clamps which are held, in turn, at vertically movable support columns. The current is fed either in current pipes guided over the support arm or via the support arms themselves. In the case of steel support arms, the current is conducted by copper or aluminum plating arranged on the outside. However, the support arm can also be made entirely of a material with good current-conducting properties.

A support arm which is produced from aluminum and is conductive in its entirety is known, for example, from the French Patent 1,336,823. Due to the small current load, the support arm itself, which is constructed as a hollow section, is not cooled. The coolant water required for the electrode clamp is supplied via pipes which are guided through the interior of the hollow section.

A support arm produced from light-metal in which liquid coolant flows through its hollow interior is known from EP 0 340 725. Pipelines are provided for supplying coolant water to the clamp clip and are connected to the clamp clip via tubes.

In the two electrode arms mentioned above, the cooling of the electrode holder constitutes a costly construction. Also, the cooling potential of the coolant is not exploited to a sufficient extent in the cooled support arm construction.

SUMMARY OF THE INVENTION

The present invention therefore has the object of avoiding the disadvantages mentioned above in a simple, lightweight, rigid construction of a support arm which can transmit high electric power and requires low maintenance.

Pursuant to this object, and others which will become apparent hereafter, one aspect of the present invention resides in a support arm whose walls consist of sections containing ducts which are arranged parallel to one another. Two ends at the head and foot of the ducts are connected with one another so as to form a coolant water circulation system of optional design.

The thickness of the walls is selected so that the support arm, which is constructed as a hollow section, is sufficiently rigid and the entire wall is safely cooled at the same time.

The hollow section can have a circular, oval, or box-like shape. The box-like shape is preferred so that the wall consists of two L-sections of equal dimensions or four flat sections welded together at the comers.

Flat sections of aluminum produced by an extrusion process are preferred for use as the walls. These sections not only have a high dimensional stability, but also possess an excellent surface quality precisely in the outer wall of the cooling duct so that no finishing work is required to achieve the desired rate of flow of the coolant.

The support arm according to the invention is distinctly lighter than previously known support arms of comparable size. This is brought about on the one hand by using walls provided with ducts so that the inherent weight of the arm is reduced while retaining comparable rigidity. But on the other hand, less water is used on the whole, since a distinctly smaller amount of water is purposefully guided through the ducts by the support arm designed as a closed coolant circulation.

The support arm according to the invention has a smooth outer form in which there are no projecting structural members exposed to possible damage. The smooth form allows a simple attachment of the electrode supporting device in the front part of the support arm. This facilitates exchange or replacement.

When three electrodes are used, the middle support arm is bent in the middle and guided over the other electrode arms to reduce induction losses.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
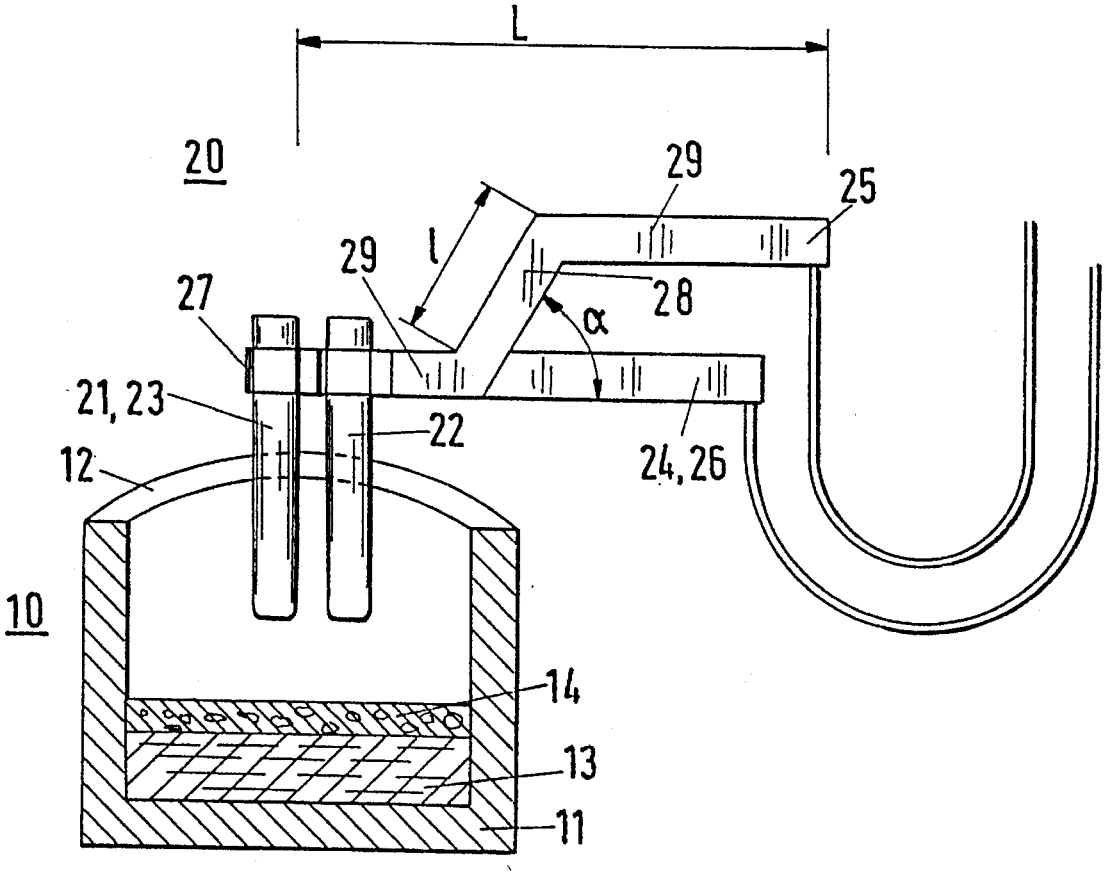
FIG. 1 shows a furnace installation.
Figure 1A:
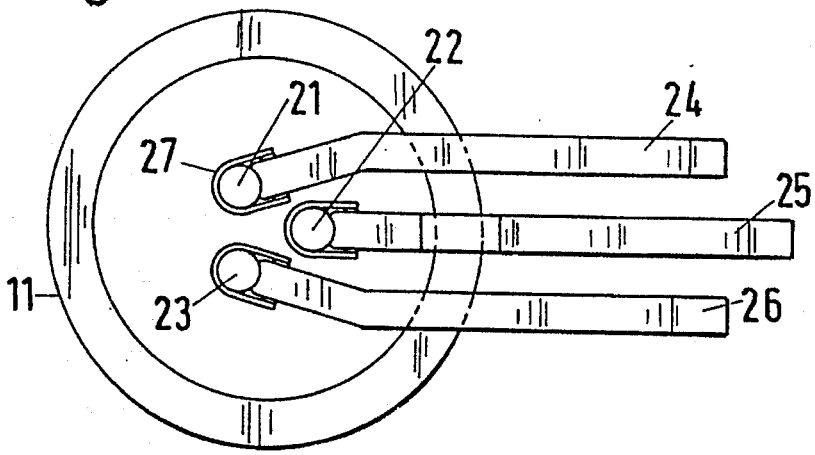
FIG. 1*a* shows a top view of FIG. 1.

FIG. 1 shows an arc furnace (10) with a furnace vessel (11) which is closed by a cover (12). A melt (13) and slag (14) are located in the furnace vessel (11).

Electrodes (21–23) project through the cover (12) into the furnace vessel (11) and are fastened by an electrode holder (27) at an electrode support arm (24) or at individual electrode arms (24–26) of an electrode supporting device (20).

When using three electrode support arms (24–26), the middle electrode support arm has a bend (28) which is homogeneously connected with the horizontal electrode support part (29). The length of the middle electrode support arm (25) is designated by "L". This length "L" has a bent length "1" in the central region. This part of the electrode support arm is arranged at a bending angle ($\alpha$) relative to the horizontal electrode support part (29).

Figure 2C:
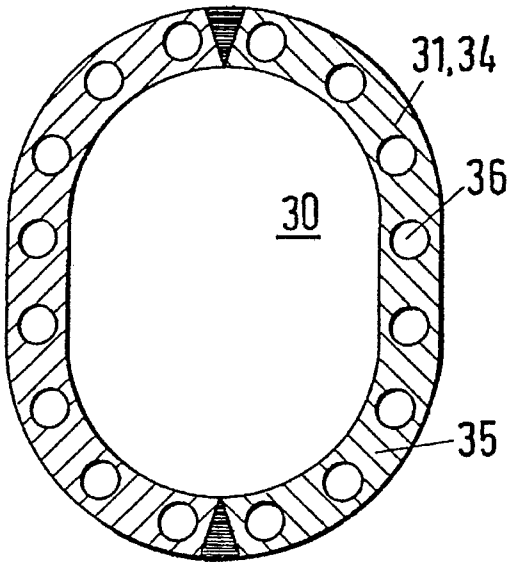
FIGS. 2*a*–2*c* show sections through an electrode support arm.
Figure 2B:
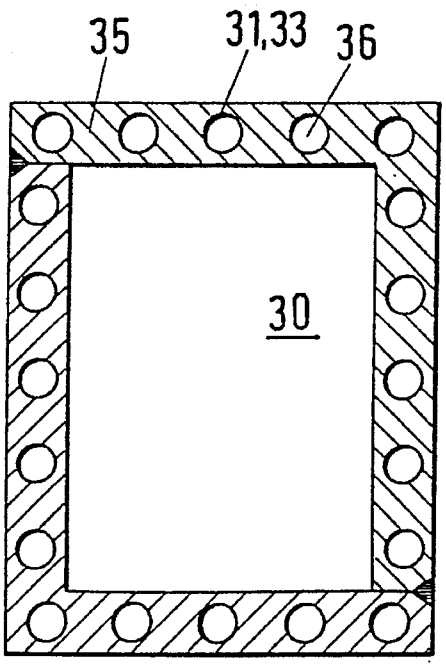
Figure 2A:
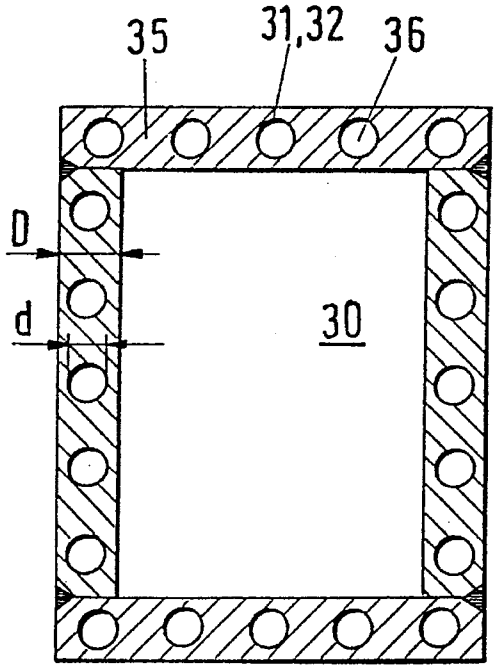

FIGS. 2*a*–2*c* show hollow sections (30) of the electrode support arm with structural aluminum members (31). These structural members (31) are extruded and have ducts (36) in the longitudinal direction whose quantity and dimensions are selected so that a sufficient cooling can be achieved without a reduction in strength.

The hollow section is advantageously constructed from at least two extruded structural members that are welded together. These structural members can be constructed as oval sections (34) (FIG. 2*c*) or as L-shaped sections (33) (FIG. 2*b*). But, as is shown in FIG. 2*a*, they can also be constructed from flat sections (32) of identical construction which are welded together at four weld locations.

Bore holes (36) having a ratio of d:D=1:1.5–2.5 are inserted in the wall (35) during the extruding process. The individual bore holes are at a distance (a) from one another, where a=1–1.5 D.

Flanges or covers are arranged at the head ends of the hollow sections and connect the parallel ducts with one another, thus enabling a defined coolant flow.

Figure 3:
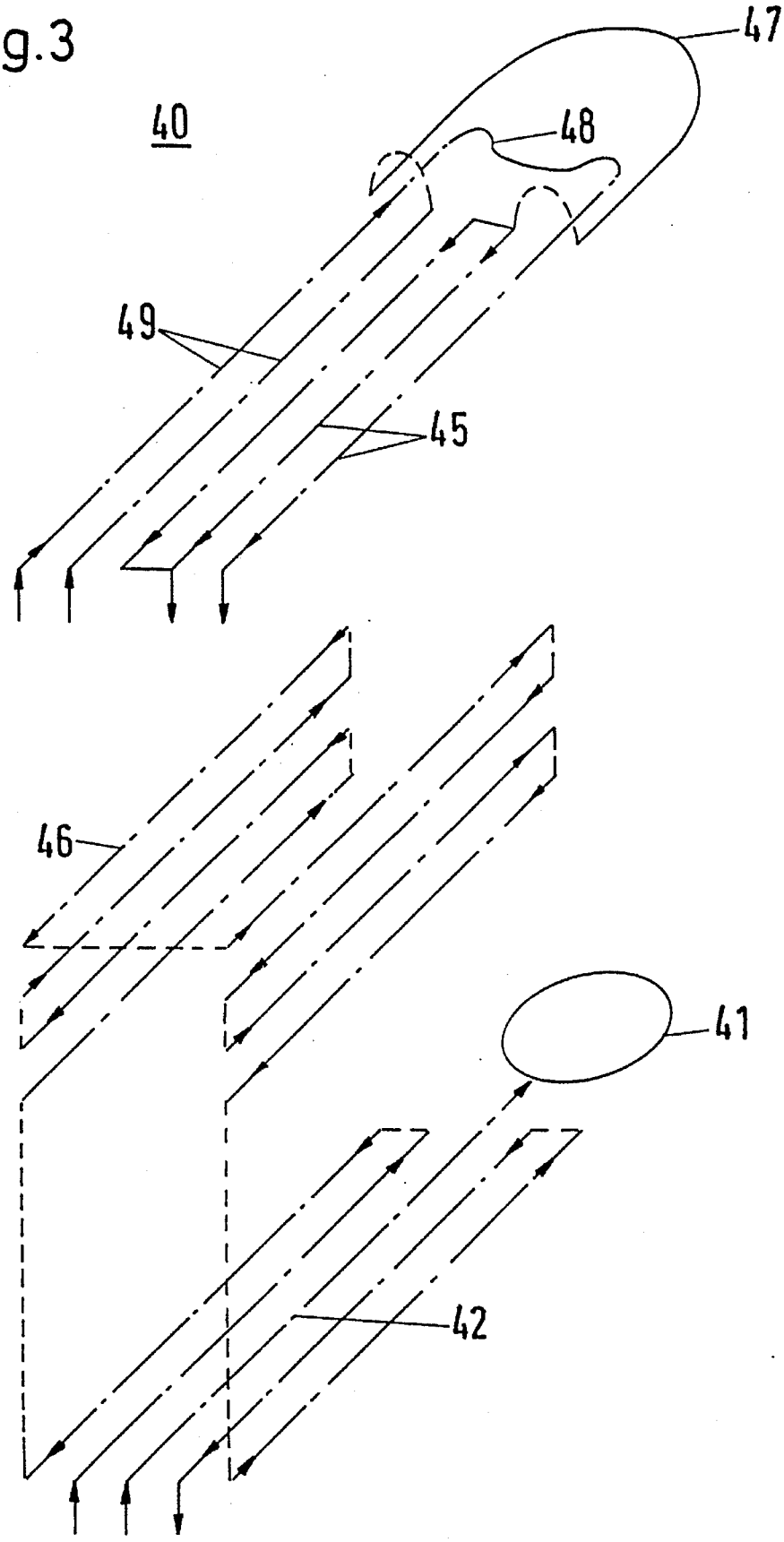
FIG. 3 shows a schematic diagram of the coolant flow.

Individual flow filaments or threads of the coolant of a coolant guiding system (40) are shown in FIG. 3. The individual ducts (36) form the coolant thread (46) which flows through most of the support arm. The electrode holder (27) has coolant threads (47 and 48) supplied by coolant threads (49). The coolant can be guided in a wide variety of ways as a result of the multitude of ducts. The bottom half of FIG. 3 shows a possibility for cooling a splash ring (41) from which the water which is supplied to it via the coolant thread (42) can flow off freely.

The invention is not limited by the embodiments described above which are presented as examples only but can be modified in various ways within the scope of protection defined by the appended patent claims.

We claim:

1. An electrode support device for arc furnaces, comprising at least one support arm constructed as a hollow section with a wall formed at least partially from current-carrying material of high conductivity and having an inner surface and an outer surface, the wall of the hollow section having a coolant guiding system including ducts arranged within the wall between the inner surface and the outer surface so as to be parallel to one another and to a center axis of the support arm, the ducts being dimensioned and provided in a quantity so as to enable sufficient cooling without a reduction in strength of the support arm.

2. An electrode support device according to claim 1, wherein the ducts have a diameter and the wall has a thickness, a ratio of the diameter (d) of the duct to the thickness (D) of the wall being d: D=1:1.5–2.5, the ducts are arranged at a distance a=1–1.5 D from one another and are connected with one another in pairs so as to form a closed coolant circulation circuit.

3. An electrode support device according to claim 1, wherein the hollow section has a box-like shape with a wall formed from at least two structural members.

4. An electrode support device according to claim 3, wherein the structural members are extruded aluminum sections of identical construction which are welded together.

5. An electrode support device according to claim 4, characterized in that the structural members are L-shaped.

6. An electrode support device according to claim 1, and further including an electrode holder provided so as to hold an electrode at the support arm, the coolant guiding system including feeds and drains, selected ones of the ducts being provided for cooling the electrode holder and are connected with the feeds and drains of the coolant guiding system.

7. An electrode support device according to claim 1, wherein, when using three electrodes, three support arms are provided adjacent one another, the electrode support arm of a middle of the three electrodes having a bend in its mid-portion with a length (1) that is in a ratio of 1:L=1:3–4 to the overall length (L) of the electrode support arm, the bend facing away from the furnace at an angle between 50° and 70° relative to horizontal.

* * * * *